US008831266B1

(12) United States Patent
Huang

(10) Patent No.: US 8,831,266 B1
(45) Date of Patent: Sep. 9, 2014

(54) TUNABLE EARPHONE

(71) Applicants: Jetvox Acoustic Corp., Taoyuan County (TW); Cooler Master Technology Inc., New Taipei (TW)

(72) Inventor: To-Teng Huang, Taoyuan County (TW)

(73) Assignees: Jetvok Acoustic Corp., Taoyuan County (TW); Cooler Master Technology Inc., Taipei (TW)

( * ) Notice: Subject to any disclaimer, the term of this patent is extended or adjusted under 35 U.S.C. 154(b) by 0 days.

(21) Appl. No.: 14/082,489

(22) Filed: Nov. 18, 2013

(30) Foreign Application Priority Data

Jul. 5, 2013 (TW) ..... 102212818 U

(51) Int. Cl.
*H04R 25/00* (2006.01)
*H04R 1/10* (2006.01)

(52) U.S. Cl.
CPC ..... *H04R 1/1091* (2013.01)
USPC ..... 381/380; 381/370; 381/371; 381/372; 381/373

(58) Field of Classification Search
CPC .. H04R 1/1016; H04R 1/1041; H04R 1/1091; H04R 1/1058; H04R 1/1083; H04R 2460/09; A61F 2011/085
USPC ..... 381/370–373, 380; 181/129–130
See application file for complete search history.

(56) References Cited

U.S. PATENT DOCUMENTS

2008/0013773 A1* 1/2008 Yang ..... 381/379
2012/0093332 A1* 4/2012 Lin et al. ..... 381/71.6
2013/0259287 A1* 10/2013 Tseng ..... 381/380

* cited by examiner

*Primary Examiner* — Matthew Eason
(74) *Attorney, Agent, or Firm* — Muncy, Geissler, Olds & Lowe, P.C.

(57) ABSTRACT

A tunable earphone includes a body, a front cavity, a rear cavity and a decorating plat. The body includes a small air hole and a large air hole. The front cavity and the rear cavity are respectively disposed on the body. The decorating plate covers the rear cavity and includes a receiving groove, a shielding member and a channel. The shielding member and the channel are disposed in the receiving groove. When the decorating plate is rotated to a first position, the shielding member shields the large air hole, the channel corresponds to the small air hole, so that the front cavity communicates with the rear cavity through the channel. When the decorating plate is rotated to a second position, the shielding member shields the small air hole, the channel corresponds to the large air hole, so that the front cavity communicates with the rear cavity through the channel.

15 Claims, 10 Drawing Sheets

TUNABLE EARPHONE

CROSS-REFERENCES TO RELATED APPLICATIONS

This non-provisional application claims priority under 35 U.S.C. §119(a) on Patent Application No. 102212818 filed in Taiwan, R.O.C. on 2013, Jul. 5, the entire contents of which are hereby incorporated by reference.

BACKGROUND

1. Technical Field

The disclosure relates to an earphone, and particularly relates to a tunable earphone.

2. Related Art

Earphones are applied widely in communication, education, multimedia and so forth. The structures of the earphones are versatile, and the earphones can be roughly divided into earmuff earphones, earbuds, ear-cap earphones, headphones, etc. Earbuds are especially popular in the market, due to their low volume, light weight and portability.

Generally, a conventional earphone is provided with low frequency performance, achieved by providing a resonating space for the low frequency sounds to resonate. Unfortunately, the low frequency performance cannot be adjusted according to the user's preferences.

SUMMARY

In view of this, the disclosure proposes a tunable earphone including a body, a front cavity, a rear cavity and a decorating plat. The body includes a small air hole and a large air hole. The front cavity is disposed on one side of the body, and the rear cavity is disposed on the other side of the body. The decorating plate covers the rear cavity. The decorating plate includes a receiving groove, a shielding member and a channel. The shielding member is disposed in the receiving groove. The channel is disposed in the receiving groove. When the decorating plate is rotated to a first position, the shielding member shields the large air hole, and the channel corresponds to the small air hole, so that the front cavity communicates with the rear cavity through the channel. While when the decorating plate is rotated to a second position, the shielding member shields the small air hole, and the channel corresponds to the large air hole, so that the front cavity communicates with the rear cavity through the channel.

Consequently, due to the area differences between the small air hole and the large air hole, the low frequency performance of the tunable earphone can be adjusted by selectively shielding the small air hole and the large air hole. Additionally, the shielding member disposed between the decorating plate and the body is deformable so as to fill gaps formed between the decorating plate and the body. Furthermore, the sealing ring disposed in the shaft hole of the connecting disk separates the front cavity from the rear cavity, so that gaps formed between the body and the connecting disk can be filled, and the gas leaking event can be prevented.

The detailed features and advantages of the disclosure are described below in great detail through the following embodiments, and the content of the detailed description is sufficient for those skilled in the art to understand the technical content of the disclosure and to implement the disclosure there accordingly. Based upon the content of the specification, the claims, and the drawings, those skilled in the art can easily understand the relevant objectives and advantages of the disclosure.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
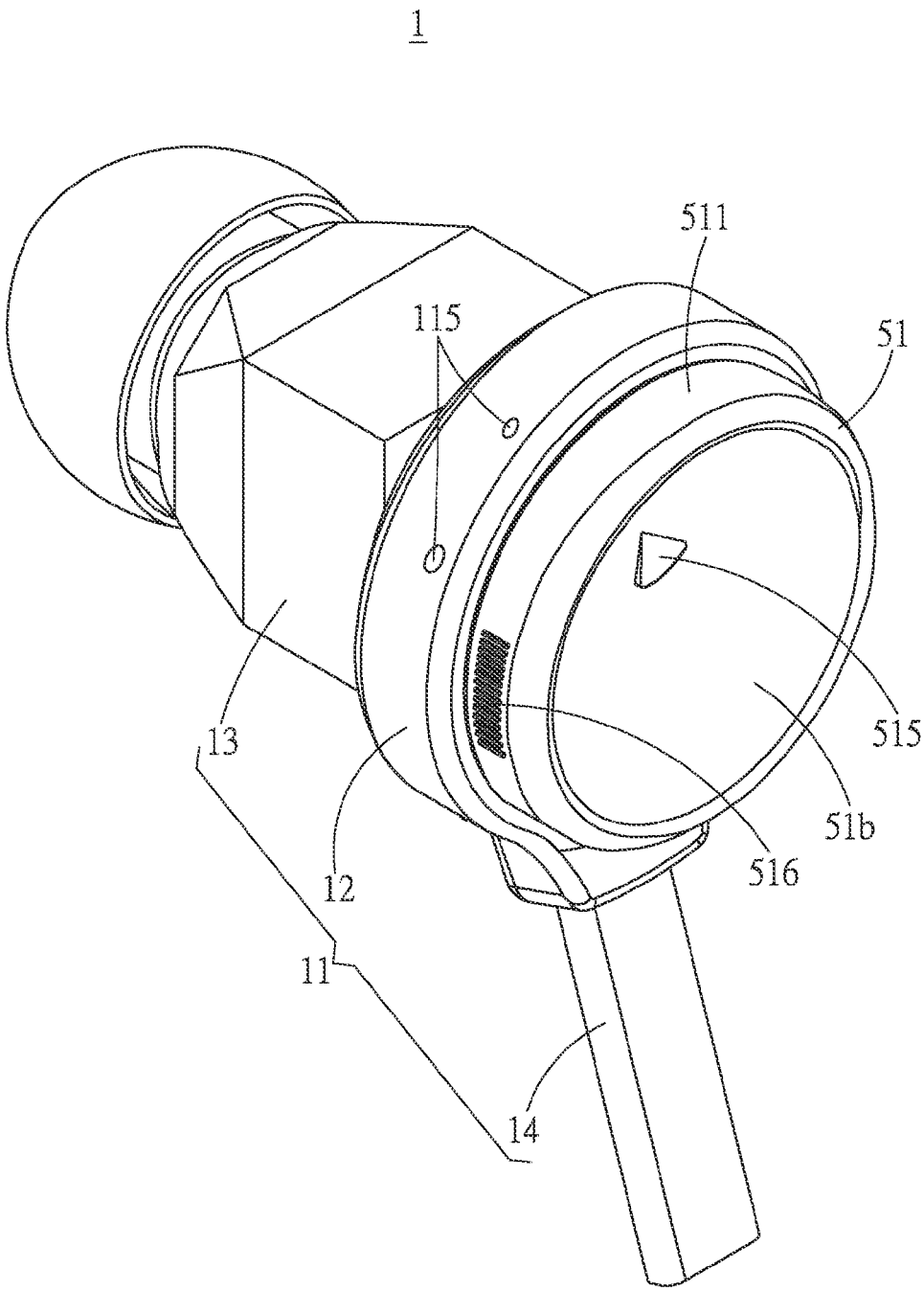
FIG. 1 is a perspective view of a tunable earphone of the disclosure.
Figure 2:
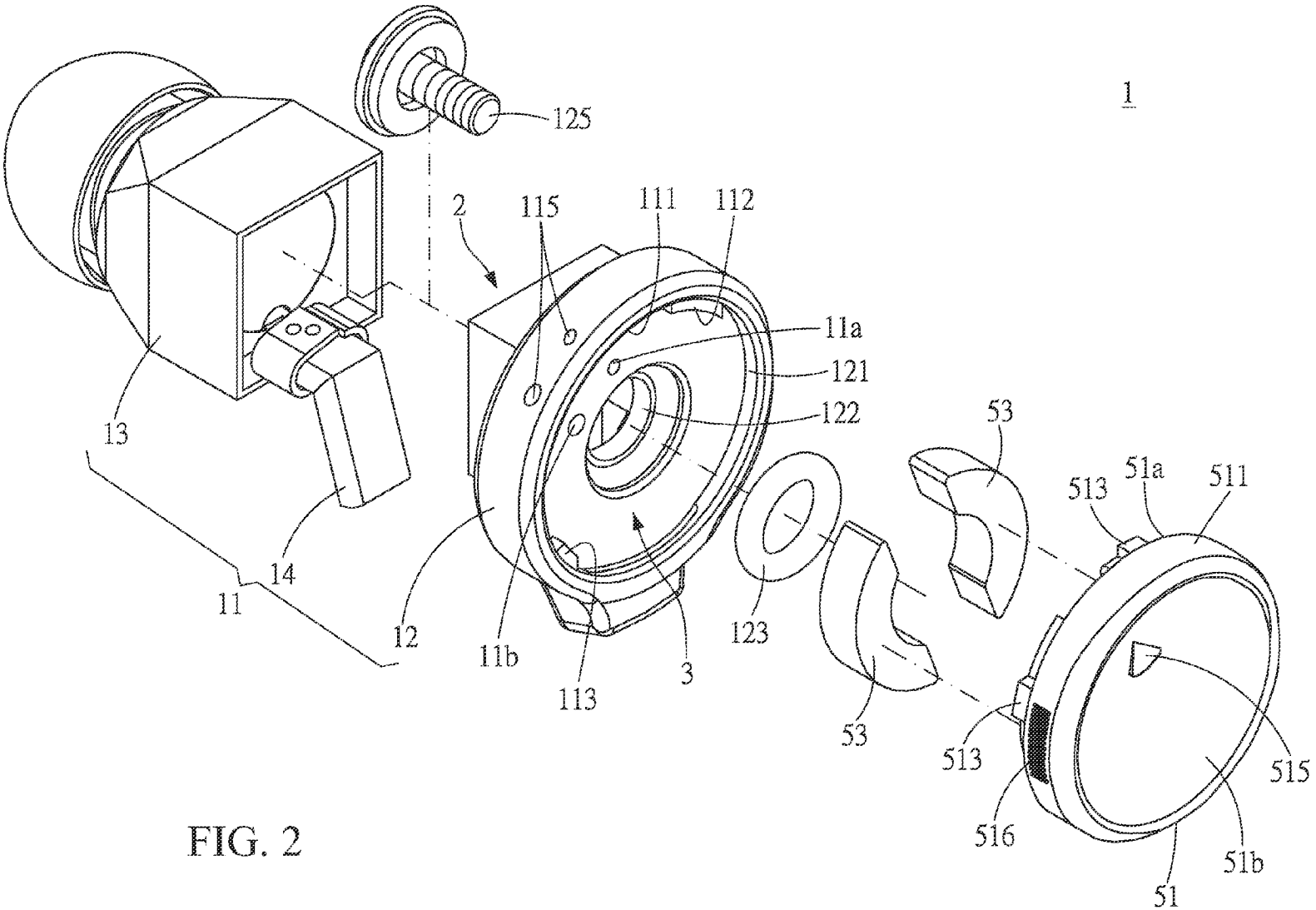
FIG. 2 is an exploded view of the tunable earphone of the disclosure.
Figure 3:
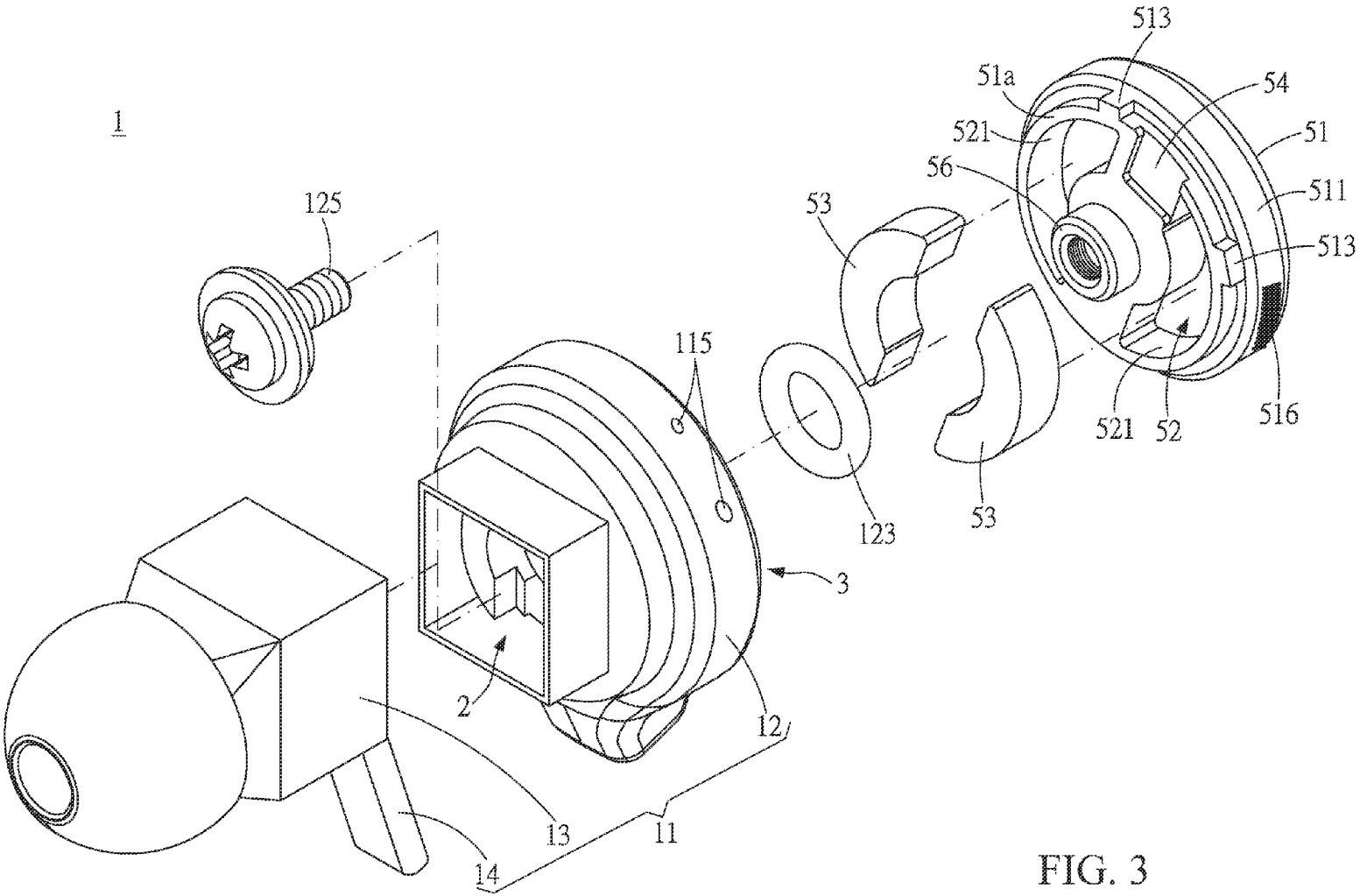
FIG. 3 is another exploded view of the tunable earphone of the disclosure.

Please refer to FIGS. 1-3, in which a tunable earphone 1 of the disclosure is provided. FIG. 1 is a perspective view of the disclosure, FIG. 2 is an exploded view of the disclosure and FIG. 3 is another exploded view of the disclosure. In this embodiment, the tunable earphone 1 is an earbud headphone, but embodiments of the disclosure are not limited thereto. The tunable earphone 1 of the disclosure is substantially consisting of a body 11, a front cavity 2, a rear cavity 3 and a decorating plate 51.

Please refer to FIGS. 2-3, in which the body 11 substantially consists of a connecting disk 12, an earbud member 13 and a signal cable 14. One end of the connecting disk 12 is connected with the earbud member 13. The front cavity 2 is disposed between the connecting disk 12 and the earbud member 13. The other end of the connecting disk 12 is connected with the decorating plate 51. The rear cavity 3 is disposed between the connecting disk 12 and the decorating plate 51. That is to say, the front cavity 2 is disposed on one side of the body 11, and the rear cavity 3 is disposed on the other side of the body 11.

Please refer to FIGS. 2-3, in which a recessed groove 121 is formed at two sides of the connecting disk 12, a small air hole 11*a* and a large air hole 11*b* are passing through the inner surface of the recessed groove 121. The connecting disk 12 communicates with the front cavity 2 and the rear cavity 3 through the small air hole 11*a* and the large air hole 11*b* respectively. In this embodiment, the diameter of the small air hole 11*a* is smaller than the diameter of the large air hole 11*b*, For example, the diameter of the small air hole 11*a* is 0.65 mm, the diameter of the large air hole 11*b* is 0.85 mm, but embodiments of the disclosure are not limited thereto; in some implementation aspects, the diameter of the small air hole 11*a* is 0.7 mm and the diameter of the large air hole 11*b* is 0.9 mm, or the diameter of the small air hole 11*a* is 0.75 mm and the diameter of the large hole 11*b* is 0.95 mm.

Additionally, an electro-acoustic transducer is assembled in the earbud member 13. The electro-acoustic transducer can be a moving coil unit or a balanced armature unit (not shown). The moving coil unit includes a magnetic body, a magnetic plate and a magnetic yoke, so that the magnetic body, the magnetic plate and the magnetic yoke form a magnetic field. The moving coil unit includes a vibrating plate and a coil, so that the vibrating plate and the coil form a vibration system. The moving coil unit is approximately formed as a circular plate; namely, a cylinder in which the height of the cylinder is smaller than the diameter of the cylinder. The balanced armature unit includes an armature motor approximately formed as a cuboid and an output orifice connected to the armature motor. Additionally, the signal cable 14 is inserted into the bottom of the connecting disk 12 and connected with the earbud member 13.

Please refer to FIGS. 2-3, in which a shaft hole 122 and a sealing ring 123 is disposed at a central part of the connecting disk 12. One end of the shaft hole 122 corresponds to the front cavity 2, and the other end of the shaft hole 122 corresponds to the rear cavity 3. The sealing ring 123 is formed as O-shaped and disposed in the shaft hole 122 so as to separate the front cavity 2 from the rear cavity 3, so that gaps are not formed between the shaft hole 122 and the sealing ring 123, and the gas leaking event can be prevented.

Figure 4:
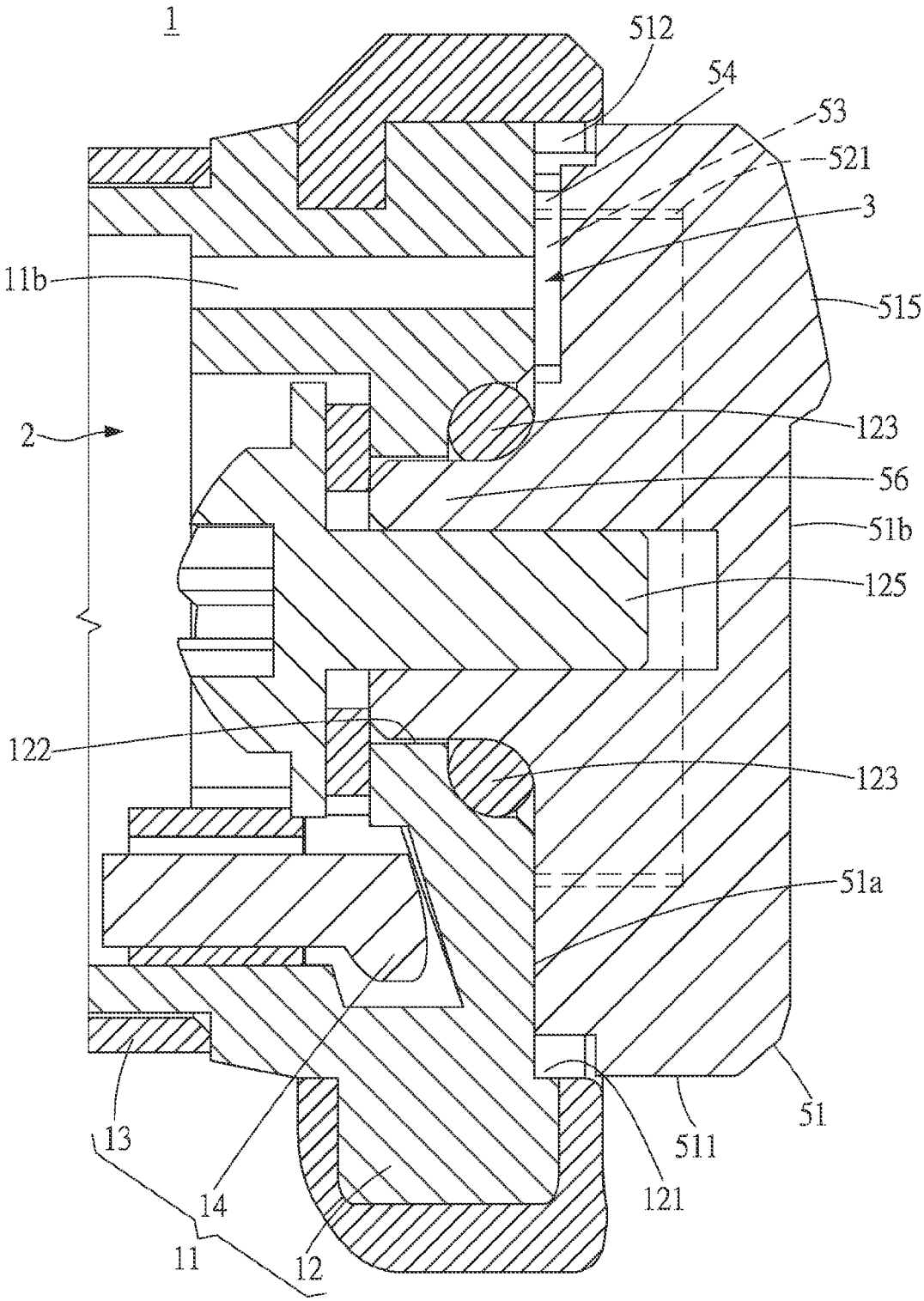
FIG. 4 is a partial lateral cross-sectional view of the tunable earphone of the disclosure.

Please refer to FIGS. 2-4, in which a locking member 125, For example a bolt, is inserted into the shaft hole 122. The locking member 125 is threaded along a direction from the front cavity 2 toward the rear cavity 3 so as to be threaded with the decorating plate 51. Here, a shaft portion 56 is disposed on the decorating plate 51. The shaft portion 56 is a round cylinder extended from a receiving groove 52 of the decorating plate 51. The shaft portion 56 is connected with the shaft hole 122, so that the sealing ring 123 is closely sleeved between the shaft portion 56 and the shaft hole 122, and gaps are not formed between the shaft portion 56 and the sealing ring 123. That is to say, the shaft portion 56 is sleeved by the sealing ring 123. One end of the locking member 125, namely, the screw nut of the bolt, is fastened with the shaft hole 122, and the other end of the locking member 125, namely, the screw rod of the bolt is threaded with the shaft portion 56. Here, the decorating plate 51 is capable of being rotating about the locking member 125.

Figure 5:
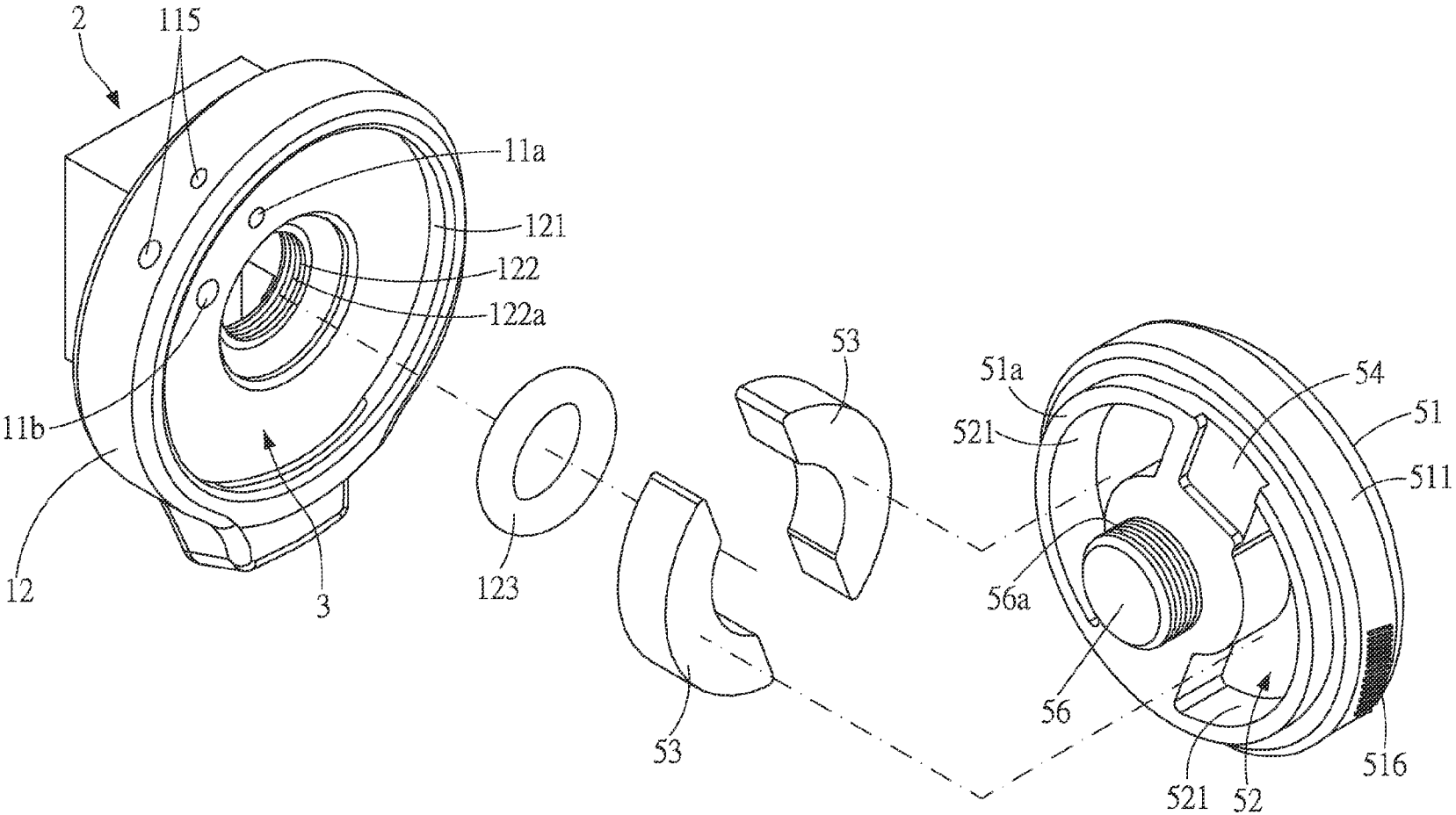
FIG. 5 is a partial exploded view of the tunable earphone of the disclosure.
Figure 6:
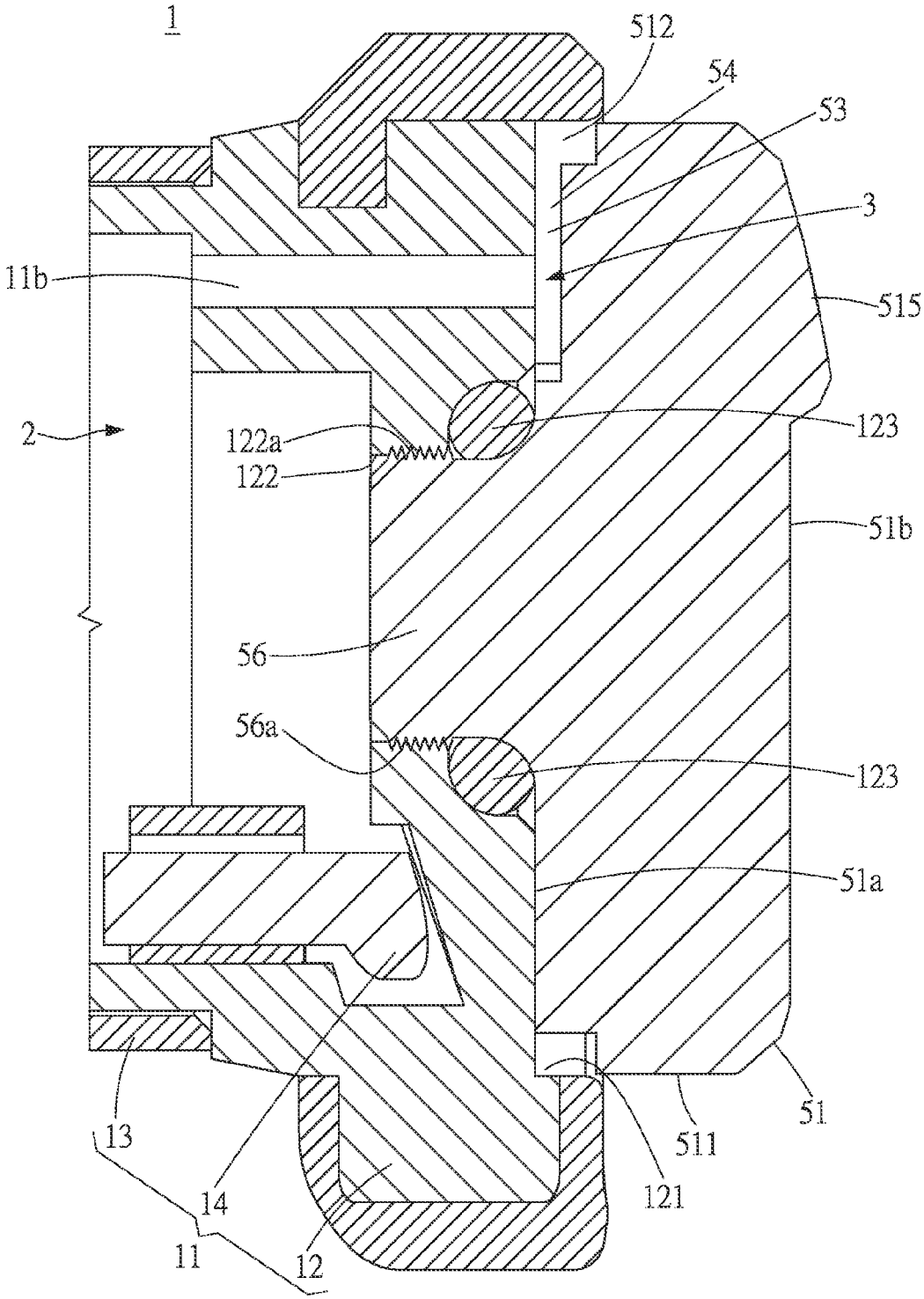
FIG. 6 is a partial lateral cross-sectional view (1) of the tunable earphone of the disclosure.

The disclosure about applying the locking member 125 to lock with the shaft hole 122 is not the only example; in some implementation aspects, an outer threaded portion 56*a* is capable of being disposed on the shaft portion 56 of the decorating plate 51 (as shown in FIGS. 5-6), and an inner threaded portion 122*a* is capable of being disposed on the inner wall of the shaft hole 122. The outer threaded portion 56*a* threads with the inner threaded portion 122*a*. The threading between the outer threaded portion 56*a* and the inner threaded portion 122*a* also allows the decorating plate 51 to be fastened and to be rotatable without applying the locking member 125. Here, the operation of the decorating plate 51 is similar to the operation of the crown of a watch, so that the decorating plate 51 is movable and rotatable.

Figure 7:
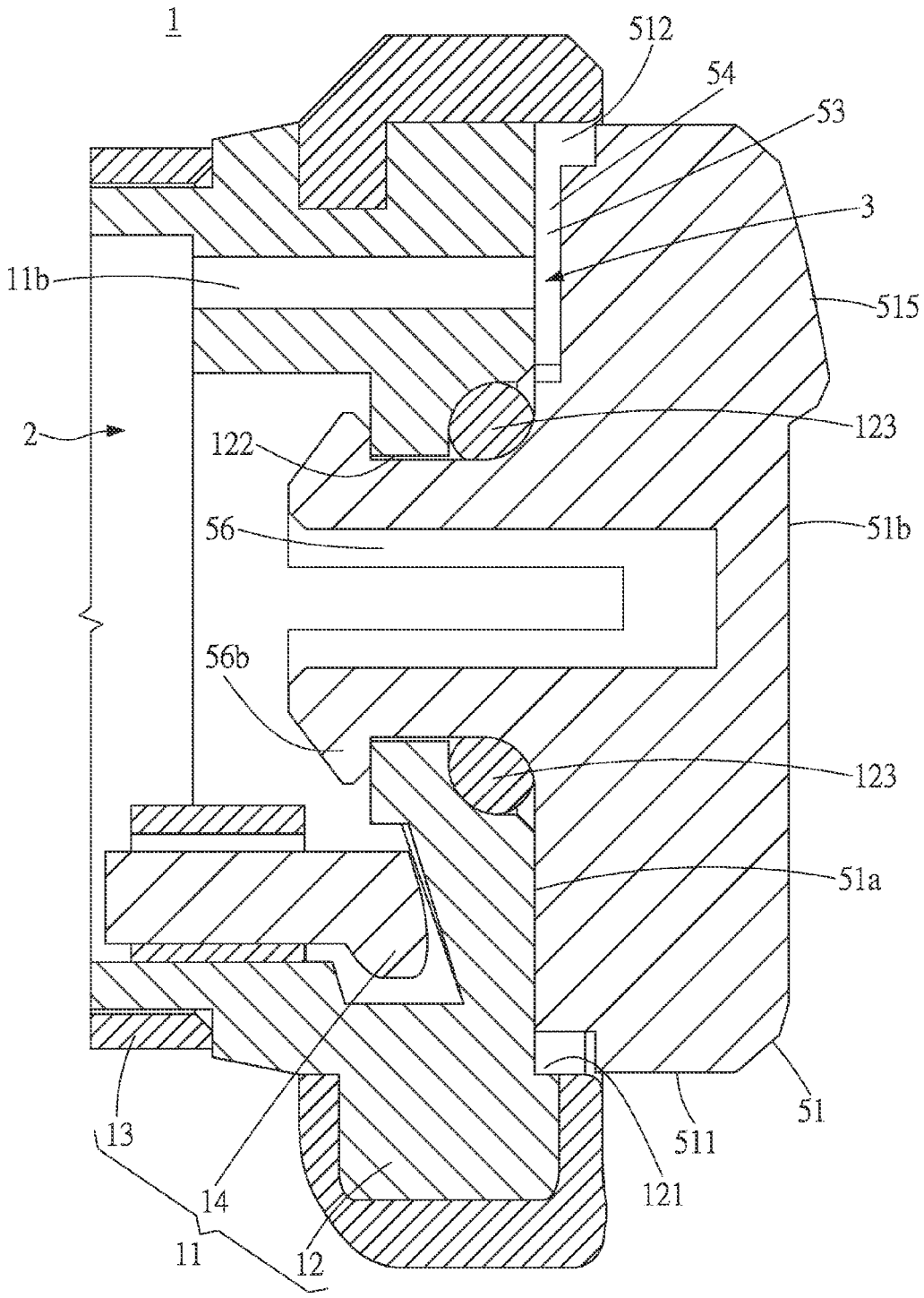
FIG. 7 is a partial lateral cross-sectional view (2) of the tunable earphone of the disclosure.
Figure 8:
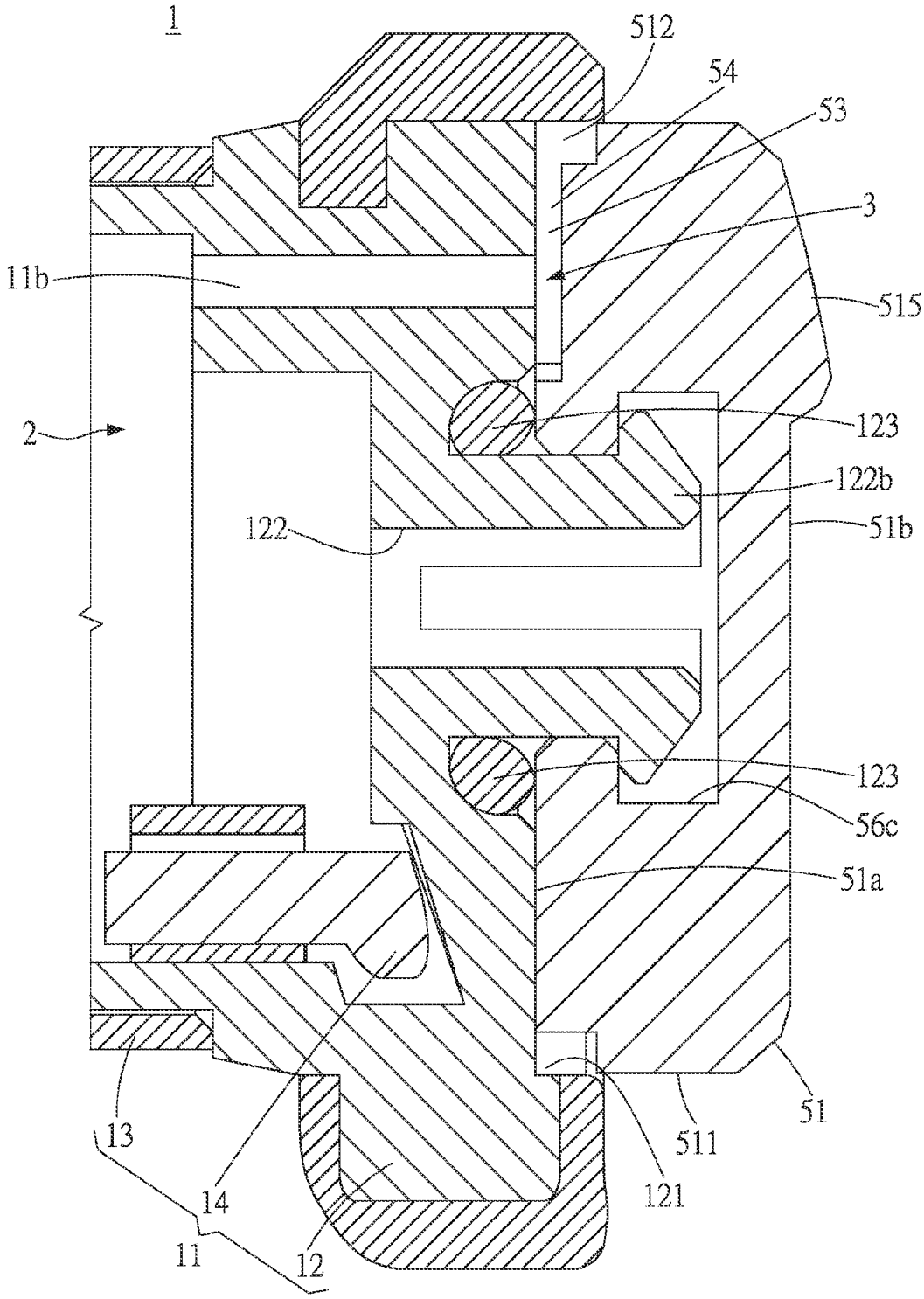
FIG. 8 is a partial lateral cross-sectional view (3) of the tunable earphone of the disclosure.

In some implementation aspects, the shaft portion 56 and the shaft hole 122 are connected with each other via buckling, as shown in FIG. 7, a hooked portion 56*b* is disposed on the shaft portion 56, and the shaft portion 56 is inserted into the shaft hole 122 with the hooked portion 56*b* fastened with the inner wall of the shaft hole 122; namely, the shaft portion 56 is connected with the shaft hole 122 via the hooked portion 56*b*, but embodiments of the disclosure are not limited thereto. In some implementation aspects, as shown in FIG. 8, a buckling groove 56*c* is disposed on the shaft portion 56, and a sub hooked portion 122*b* is disposed on the shaft hole 122, so that the sub hooked portion 122*b* is fastened with the buckling groove 56*c*, and the decorating plate 51 is also rotatable on the body 11.

Please refer to FIGS. 2-4, in which the decorating plate 51 is a circular plate. The decorating plate 51 has a first plane 51*a*, a second plane 51*h*, and a side portion 511 formed between the first plane 51*a* and the second plane 51*b*. The side portion 511 is connected with the body 11. The first plane 51*a* of the decorating plate 51 covers the rear cavity 3, so that a gas leaking hole 512 is formed between the rear cavity 3 and the first plane 51*a*. That is to say, the gas leaking hole 512 is disposed between the body 11 and the side portion 511 and communicates with a channel 54 of the decorating plate 51.

Please refer to FIGS. 2-4, in which the first plane 51*a* of the decorating plate 51 is substantially consisting of the receiving groove 52, a shielding member 53 and the channel 54. The receiving groove 52 is recessed on the first plane 51*a* so as to form a plurality of recessed holes 521 with different depths. The shielding member 53 is disposed in the recessed hole 521 with larger depth and protruded out of the first plane 51*a*. The channel 54 is disposed in the recessed hole 521 with smaller depth. The shielding member 53 is made of a soft and elastic material so as to be compressed to deform and capable of being made of rubber or foam, or made of synthetic resin like, polypropylene. When the decorating plate 51 is combined with the body 11, the shielding member 53 is compressed so as to fill the gaps between the decorating plate 51 and the body 11.

Figure 9:
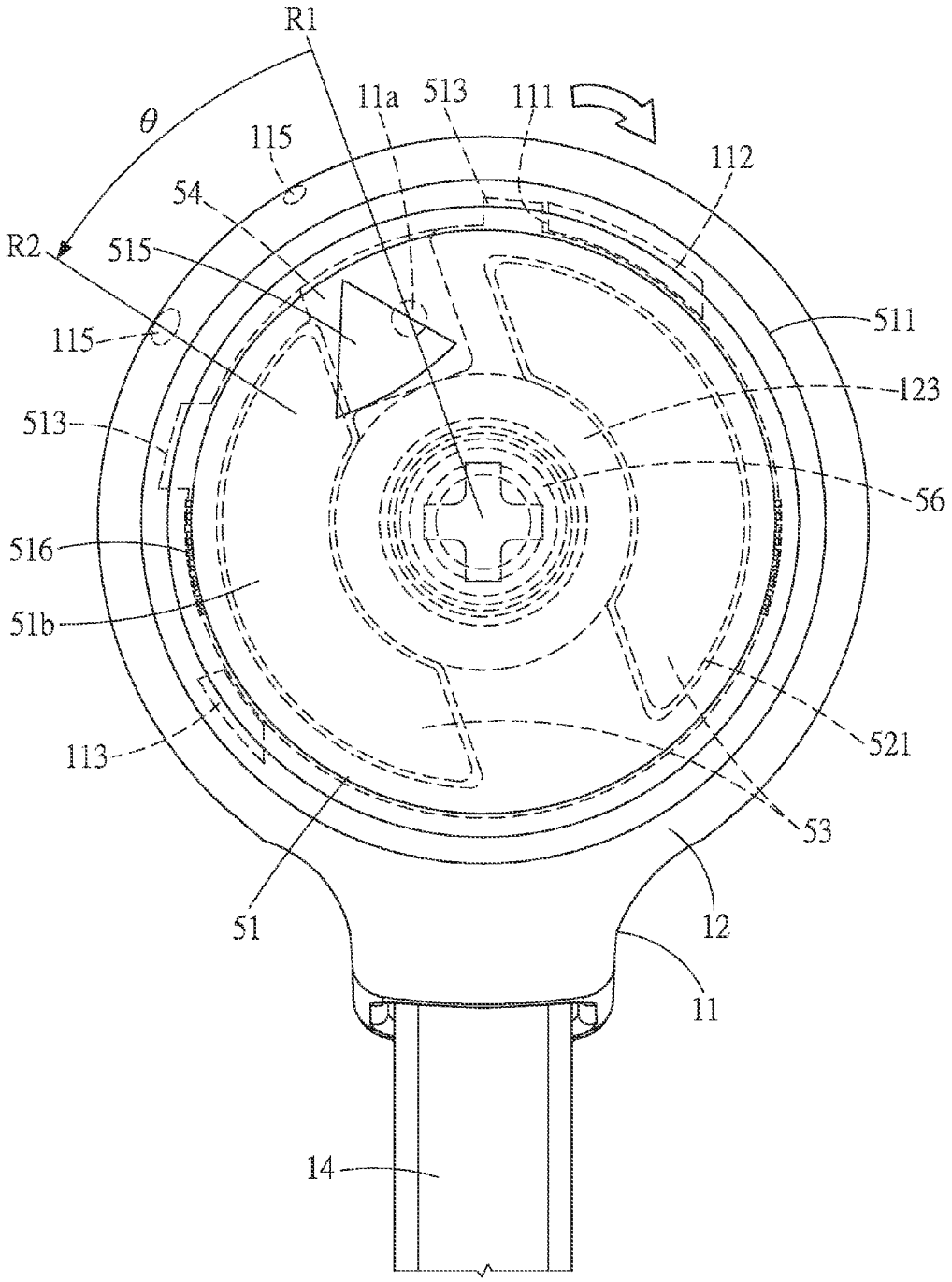
FIG. 9 is a schematic view (1) showing the rotation of a decorating plate of the tunable earphone.
Figure 10:
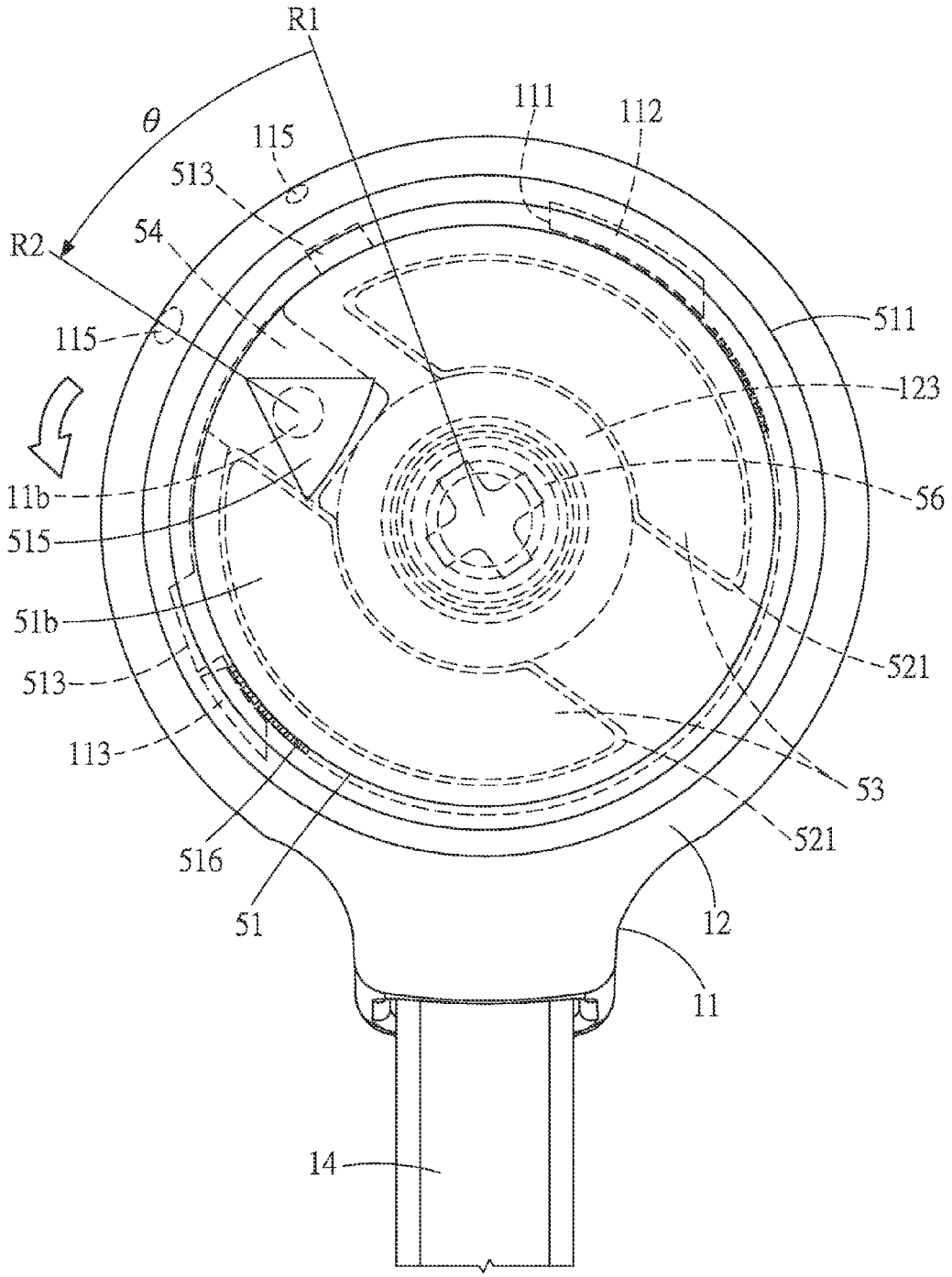
FIG. 10 is a schematic view (2) showing the rotation of the decorating plate of the tunable earphone.

Please refer to FIGS. 9-10, in which the interval of a rotating angle θ of the decorating plate 51 is limited. Here, the rotating angle θ is equal to or larger than 30 degrees (for example, 35 degrees, 40 degrees and so forth), but embodiments of the disclosure are not limited thereto. In addition, one end of the rotating angle θ corresponds to a first position R1 of the rotating path of the decorating plate 51, and the other end of the rotating angle θ corresponds to a second position R2 of the rotating path of the decorating plate 51. The rotating angle θ is larger than or equal to an angle defined between the large air hole 11*b* and the small air hole 11*a*.

Please refer to FIGS. 9-10, in which when the decorating plate 51 is rotated to the first position R1, the shielding member 53 shields the large air hole 11*b*, and the channel 54 corresponds to the small air hole 11*a*, so that the front cavity 2 communicates with the rear cavity 3 via, the channel 54 and the small air hole 11*a*, namely, the large air hole 11*b* is shielded and the small air hole 11*a* is air permeable so as to achieve a low frequency performance. When the decorating plate 51 is rotated to the second position R2, the shielding member 53 shields the small air hole 11*a*, and the channel 54 corresponds to the large air hole 11*b*, so that the front cavity 2 communicates with the rear cavity 3 via the channel 54 and the large air hole 11*b*, namely, the small air hole 11*a* is shielded and the large air hole 11*b* is air permeable so as to further improve the low frequency performance. Based on this, since the area differences between the small air hole 11*a* and the large air hole 11*b*, the low frequency performance of the tunable earphone 1 can be adjusted.

Please refer to FIGS. 9-10, in which the decorating plate 51 is rotatable within the interval. In this embodiment, the body 11 has a sliding groove 111, a first block 112 and a second block 113. The first block 112 is disposed at one side of the sliding groove 111, and the second block 113 is disposed at the other side of the sliding groove 111. The decorating plate 51 has a sliding block 513 disposed in the sliding groove 111. When the decorating plate 51 is rotated to the first position R1, the sliding block 513 is abutted against the first block 112;

when the decorating plate 51 is rotated to the second position R2, the sliding block 513 is abutted against the second block 113. Based on this, the decorating plate 51 is positioned by the first block 112 and the second block 113 during rotation. The disclosure about the structures of the sliding groove 111 and the sliding block 513 is not the only example, in some implementation aspects, the sliding block 513 is assembled on the body 11 and the sliding groove 111 corresponding to the sliding block 513 is disposed on the decorating plate 51.

Please refer to FIG. 2, FIG. 9 and FIG. 10, in which the rotating direction can be indicated. In this embodiment, the second plane 51*b* of the decorating plate 51, which is also a visible plane in FIGS. 9-10, has an indicating portion 515 such as an arrow mark, but embodiments of the disclosure are not limited thereto; for example, the indicating portion 515 can be printed with texts, features or pattern for acquiring the rotating direction. The indicating portion 515 is disposed on the decorating plate 51. Furthermore, the body 11 has a plurality of positioning portions 115, like circles with different sizes, but embodiments of the disclosure are not limited thereto; for example, the positioning portions 115 can be printed with arrow marks, or can be recessed breaches or protruding blocks, so that the rotating direction can be acquired. In this embodiment, the positioning portions 115 are disposed on the body 11, and when the decorating plate 51 is rotated to a certain angle, the indicating portion 515 corresponds to one of the positioning portions 115.

Please refer to FIG. 2 and FIGS. 9-10, in which the decorating plate 51 can be rotated manually. In this embodiment, the decorating plate 51 has a switching portion 516. The switching portion 516 is disposed on the side portion 511 of the decorating plate 51, so that a user rotates the decorating plate 51 manually via the switching portion 516. For example, the switching portion 516 is a plurality of extruding blocks, so that the user rotates the decorating plate 51 by the switching portion 516, but embodiments of the disclosure are not limited thereto; in another example, the switching portion 516 is a plurality of recessed slots.

In this disclosure, the shielding member and the channel are disposed on the decorating plate. When the decorating plate is rotated to the first position, the shielding member shields the large air hole, and the channel corresponds to the small air hole, so that the front cavity communicates with the rear cavity through the channel and the small air hole. When the decorating plate is rotated to the second position, the shielding member shields the small air hole, and the channel corresponds to the large air hole, so that the front cavity communicates with the rear cavity through the channel and the large air hole. Consequently, due to the area differences between the small air hole and the large air hole, the low frequency performance of the tunable earphone can be adjusted by selectively shielding the small air hole and the large air hole. Additionally, the shielding member disposed between the decorating plate and the body is deformable so as to fill gaps formed between the decorating plate and the body. Furthermore, the sealing ring disposed in the shaft hole of the connecting disk separates the front cavity from the rear cavity, so that gaps formed between the body and the connecting disk can be filled, and the gas leaking event can be prevented.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A tunable earphone, comprising:

a body, comprising a small air hole and a large air hole;

a front cavity, disposed on one side of the body;

a rear cavity, disposed on the other side of the body; and a decorating plate, covering the rear cavity, comprising:

a receiving groove;

a shielding member, disposed in the receiving groove; and a channel, disposed in the receiving groove;

wherein when the decorating plate is rotated to a first position, the shielding member shields the large air hole, and the channel corresponds to the small air hole, so that the front cavity communicates with the rear cavity through the channel; when the decorating plate is rotated to a second position, the shielding member shields the small air hole, and the channel corresponds to the large air hole, so that the front cavity communicates with the rear cavity through the channel.

2. The tunable earphone according to claim 1, wherein the body comprising:

a shaft hole, one end thereof corresponding to the front cavity, the other end thereof corresponding to the rear cavity; and a sealing ring, disposed in the shaft hole.

3. The tunable earphone according to claim 2, wherein the decorating plate comprises a shaft portion, extended from the receiving groove and sleeved by the sealing ring.

4. The tunable earphone according to claim 3, wherein the shaft portion comprises an outer threaded portion, the shaft hole comprises an inner threaded portion, the outer threaded portion threads with the inner threaded portion.

5. The tunable earphone according to claim 3, wherein the shaft portion comprises a hooked portion for connecting with the shaft hole.

6. The tunable earphone according to claim 3, wherein the shaft hole comprises a sub hooked portion, the shaft portion comprises a buckling groove, and the sub hooked portion is fastened with the buckling groove.

7. The tunable earphone according to claim 2, wherein the body comprises a locking member, one end thereof is fastened with the shaft hole, and the other end thereof is threaded with the decorating plate.

8. The tunable earphone according to claim 1, wherein the decorating plate has a rotating angle, one end of the rotating angle corresponds to the first position, and the other end of the rotating angle corresponds to the second position, the rotating angle is larger than or equal to an angle defined between the large air hole and the small air hole.

9. The tunable earphone according to claim 8, wherein the rotating direction is larger than or equal to 30 degrees.

10. The tunable earphone according to claim 1, wherein the body comprises:

a sliding groove, a first block, disposed at one side of the sliding groove; and a second block, disposed at the other side of the sliding groove.

11. The tunable earphone according to claim 10, wherein the decorating plate comprises a sliding block, the sliding block is disposed in the sliding groove.

12. The tunable earphone according to claim 1, wherein the decorating plate comprises:

a side portion, connected with the body; and a gas leaking hole, disposed on the side portion and communicating with the channel.

13. The tunable earphone according to claim 1, wherein the shielding member is made of a material selected from a group consisting of elastic and soft materials.

14. The tunable earphone according to claim 1, wherein the decorating plate comprises an indicating portion disposed thereon, and the body comprises a plurality of positioning portions disposed thereon, and the indicating portion corresponds to one of the positioning portions.

15. The tunable earphone according to claim 1, wherein the decorating plate comprises a switching portion disposed on the side portion thereof.

* * * * *